US012345255B2

(12) United States Patent
Onoda et al.

(10) Patent No.: US 12,345,255 B2
(45) Date of Patent: Jul. 1, 2025

(54) PUMP DEVICE

(71) Applicant: TOYOTA JIDOSHA KABUSHIKI KAISHA, Toyota (JP)

(72) Inventors: Naoto Onoda, Sunto-gun (JP); Takahiro Shiina, Numazu (JP); Hideaki Komada, Numazu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/134,106

(22) Filed: Apr. 13, 2023

(65) Prior Publication Data

US 2023/0349377 A1 Nov. 2, 2023

(30) Foreign Application Priority Data

Apr. 27, 2022 (JP) ..... 2022-073763

(51) Int. Cl.
*F04C 11/00* (2006.01)
*F04C 2/10* (2006.01)

(52) U.S. Cl.
CPC ..... *F04C 11/001* (2013.01); *F04C 2/10* (2013.01); *F04C 2210/206* (2013.01); *F04C 2240/40* (2013.01); *F04C 2270/051* (2013.01)

(58) Field of Classification Search
CPC .. F04C 2/10; F04C 2/101; F04C 2/102; F04C 2/103; F04C 11/001; F04C 11/003;
(Continued)

(56) References Cited

U.S. PATENT DOCUMENTS 5,775,881 A * 7/1998 Stich ..... F01M 1/12 417/428
8,734,140 B2 * 5/2014 Wilton ..... F16N 13/20 418/32

(Continued)

FOREIGN PATENT DOCUMENTS

CN 116480760 A * 7/2023
EP 3708796 A1 * 9/2020 ..... F01M 1/02

(Continued)

OTHER PUBLICATIONS

EP3708796A1, Machine Translation of EP-3708796-A1 (Year: 2020).*
CN116480760A_MT, machine translation of CN-116480760-A (Year: 2023).*

*Primary Examiner* — Essama Omgba
*Assistant Examiner* — Charles W Nichols
(74) *Attorney, Agent, or Firm* — Oliff PLC

(57) ABSTRACT

A pump device, that supplies a liquid reserved in a reservoir to a first liquid supply destination and a second liquid supply destination, includes: a first pump whose suction port and discharge port are not switched between at forward rotation and at reverse rotation; a second pump whose suction port and discharge port are switched each other between at forward rotation and at reverse rotation; a power source that optionally switches a rotation direction of the power source; a shaft member that is rotated by a driving force from the power source; and a control device that controls at least a rotation direction of the power source. Further, the first pump and the second pump are provided on the shaft member, the first pump is connected to the first liquid supply destination, and the second pump is connected to the second liquid supply destination.

3 Claims, 8 Drawing Sheets

(58) Field of Classification Search
CPC ..... F04C 11/005; F04C 11/008; F04C 2210/206; F04C 2240/40; F04C 2270/051
See application file for complete search history.

(56) References Cited

U.S. PATENT DOCUMENTS

| | | | | |
|---|---|---|---|---|
| 10,094,305 | B1 * | 10/2018 | Klein | F02D 1/02 |
| 10,119,539 | B2 * | 11/2018 | Schweiher | F04C 14/12 |
| 11,168,675 | B2 | 11/2021 | Nassif | |
| 11,353,103 | B2 | 6/2022 | Kawanishi et al. | |

FOREIGN PATENT DOCUMENTS

| | | | |
|---|---|---|---|
| JP | 2005-041301 | A | 2/2005 |
| JP | 2014-128174 | A | 7/2014 |
| JP | 2019-065960 | A | 4/2019 |
| JP | 2019-210934 | A | 12/2019 |
| JP | 2020-148150 | A | 9/2020 |
| JP | 2021-175887 | A | 11/2021 |

* cited by examiner

PUMP DEVICE

CROSS-REFERENCE TO RELATED APPLICATION(S)

The present application claims priority to and incorporates by reference the entire contents of Japanese Patent Application No. 2022-073763 filed in Japan on Apr. 27, 2022.

BACKGROUND

The present disclosure relates to a pump device.

Japanese Laid-open Patent Publication No. 2019-065960 discloses a technique for supplying oil to an object to be lubricated at the time of forward rotation and supplying oil to a parking device at the time of reverse rotation by using, in an electric oil pump, a first port as a suction side and a second discharge port as a discharge side at the time of forward rotation and using the second port as a suction side and the first port as a discharge side at the time of reverse rotation.

In a pump device capable of supplying oil to two oil supply destinations, if a mechanism for switching an oil passage such as a check valve is provided so that oil can be constantly supplied to one of the oil supply destinations and oil can be supplied to the other oil supply destination only when necessary, costs may increase.

SUMMARY

There is a need for providing a pump device capable of constantly supplying liquid to a first liquid supply destination and supplying liquid to a second liquid supply destination only when necessary while inhibiting an increase in cost.

According to an embodiment, a pump device supplies a liquid reserved in a reservoir to a first liquid supply destination and a second liquid supply destination, includes: a first pump whose suction port and discharge port are not switched between at forward rotation and at reverse rotation; a second pump whose suction port and discharge port are switched each other between at forward rotation and at reverse rotation; a power source that optionally switches a rotation direction of the power source; a shaft member that is rotated by a driving force from the power source; and a control device that controls at least a rotation direction of the power source. Further, the first pump and the second pump are provided on the shaft member, the first pump is connected to the first liquid supply destination, and the second pump is connected to the second liquid supply destination.

DETAILED DESCRIPTION

An embodiment of a pump device according to the present disclosure will be described below. Note that the present embodiment does not limit the present disclosure.

Figure 1:
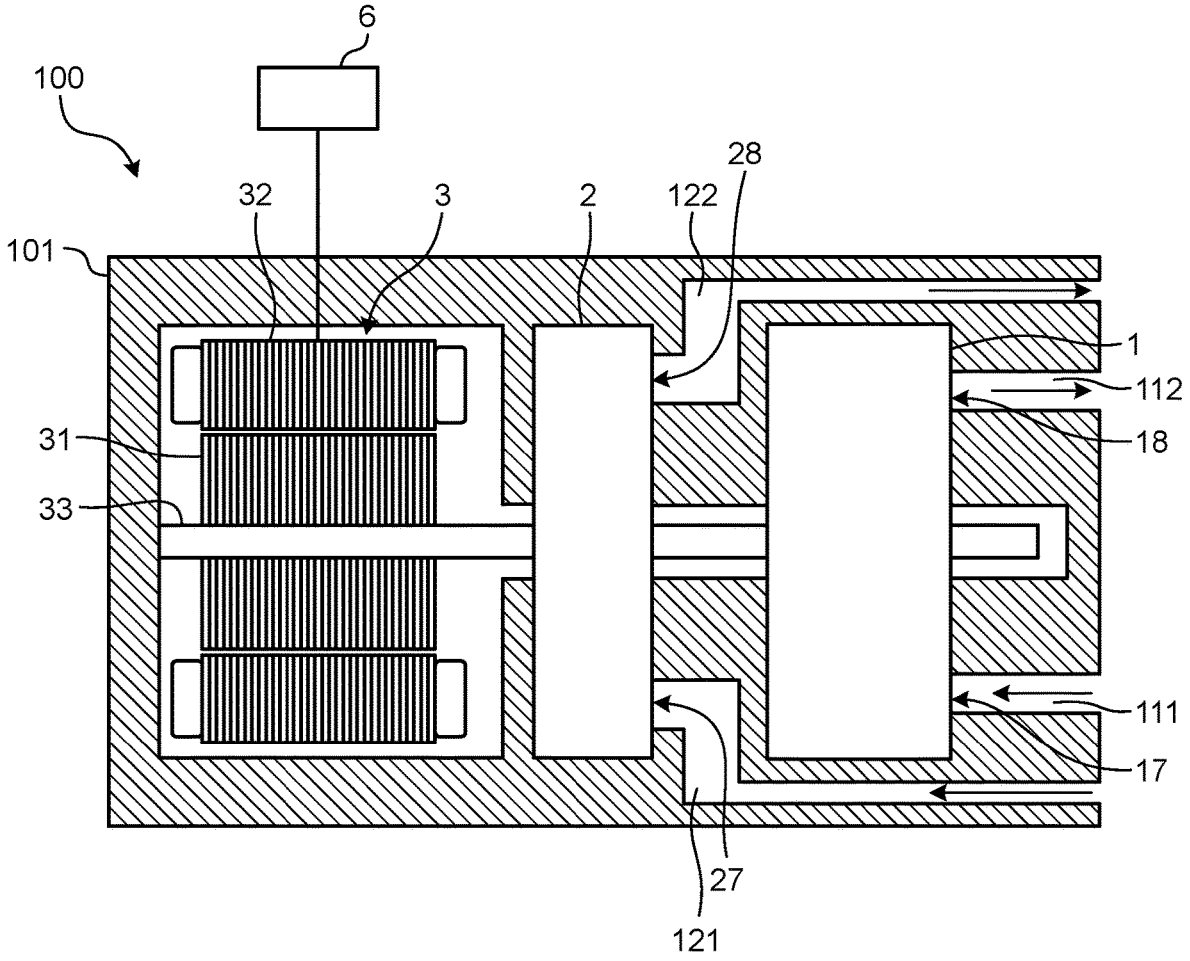
FIG. 1 illustrates a schematic configuration of a pump device according to an embodiment.

FIG. 1 illustrates a schematic configuration of a pump device 100 according to the embodiment. The pump device 100 according to the embodiment includes a first oil pump 1, a second oil pump 2, a pump drive motor 3, a case 101, and a pump control device 6. The case 101 houses and holds these components inside the case 101 itself, and is provided with a plurality of oil passages. The pump control device 6 controls driving of the pump drive motor 3.

The pump device 100 according to the embodiment is applied to, for example, a vehicle. The pump device 100 supplies oil to a place that needs to be lubricated or cooled with liquid (fluid) oil. The place includes a sliding portion, such as a gear mechanism of a reduction gear, and a heat generating portion such as a motor. The motor is a rotary electric machine serving as a drive source that is supplied with electric power and that generates driving force for causing the vehicle to travel.

The first oil pump 1 is capable of performing a forward rotation and a reverse rotation. The first oil pump 1 includes a first port 17 and a second port 18. The first port 17 communicates with a first oil passage 111 provided in the case 101. The second port 18 communicates with a second oil passage 112 provided in the case 101. The first port 17 functions as a suction port at both the times of the forward rotation and the reverse rotation of the first oil pump 1. The second port 18 functions as a discharge port at both the times of the forward rotation and the reverse rotation of the first oil pump 1. Although a displacement pump is used as the first oil pump 1, the first oil pump 1 is not limited to the displacement pump.

The second oil pump 2 is capable of performing a forward rotation and a reverse rotation. The second oil pump 2 includes a first port 27 and a second port 28. The first port 27 communicates with a first oil passage 121 provided in the case 101. The second port 28 communicates with a second oil passage 122 provided in the case 101. The first port 27 functions as a suction port at the time of forward rotation of the second oil pump 2, and functions as a discharge port at the time of reverse rotation of the second oil pump 2. The second port 18 functions as a discharge port at the time of forward rotation of the second oil pump 2, and functions as a suction port at the time of reverse rotation of the second oil pump 2. Although a displacement pump is used as the second oil pump 2, the second oil pump 2 is not limited to the displacement pump.

The pump drive motor 3 is a power source that is driven by electric power supplied from an electric power source (not illustrated) and that can optionally switch a rotation direction. The pump drive motor 3 includes a rotor 31, stators 32, and a drive shaft 33. The stators 32 are arranged at predetermined intervals on the outer peripheral side of the rotor 31. The drive shaft 33 is fixed to the rotor 31. The first oil pump 1 and the second oil pump 2 driven by the pump drive motor 3 are coaxially provided on the drive shaft 33.

The pump control device 6 controls a drive state, such as a rotation direction and a rotation speed, of the pump drive motor 3. The pump control device 6 includes a plurality of so-called microcomputers including a CPU, a ROM, a RAM, and an input/output interface. The pump control device 6 executes drive control of the pump drive motor 3 by performing signal processing in accordance with a program preliminarily stored in the ROM while using a temporary storage function of the RAM.

Next, one example of a configuration of the first oil pump 1 in which the suction port and the discharge port are not switched between at the time of forward rotation and at the time of reverse rotation and used with no change will be described. Note that the configuration of the first oil pump 1 is not limited to the configuration to be described below. A known configuration may be appropriately applied as long as the suction port and the discharge port are not switched between at the time of forward rotation and at the time of reverse rotation and used with no change. Note that, since a known configuration used commonly in a vehicle can be appropriately applied as the second oil pump 2 in which the suction port and the discharge port are switched between at the time of forward rotation and at the time of reverse rotation, description thereof will be omitted.

Figure 2:
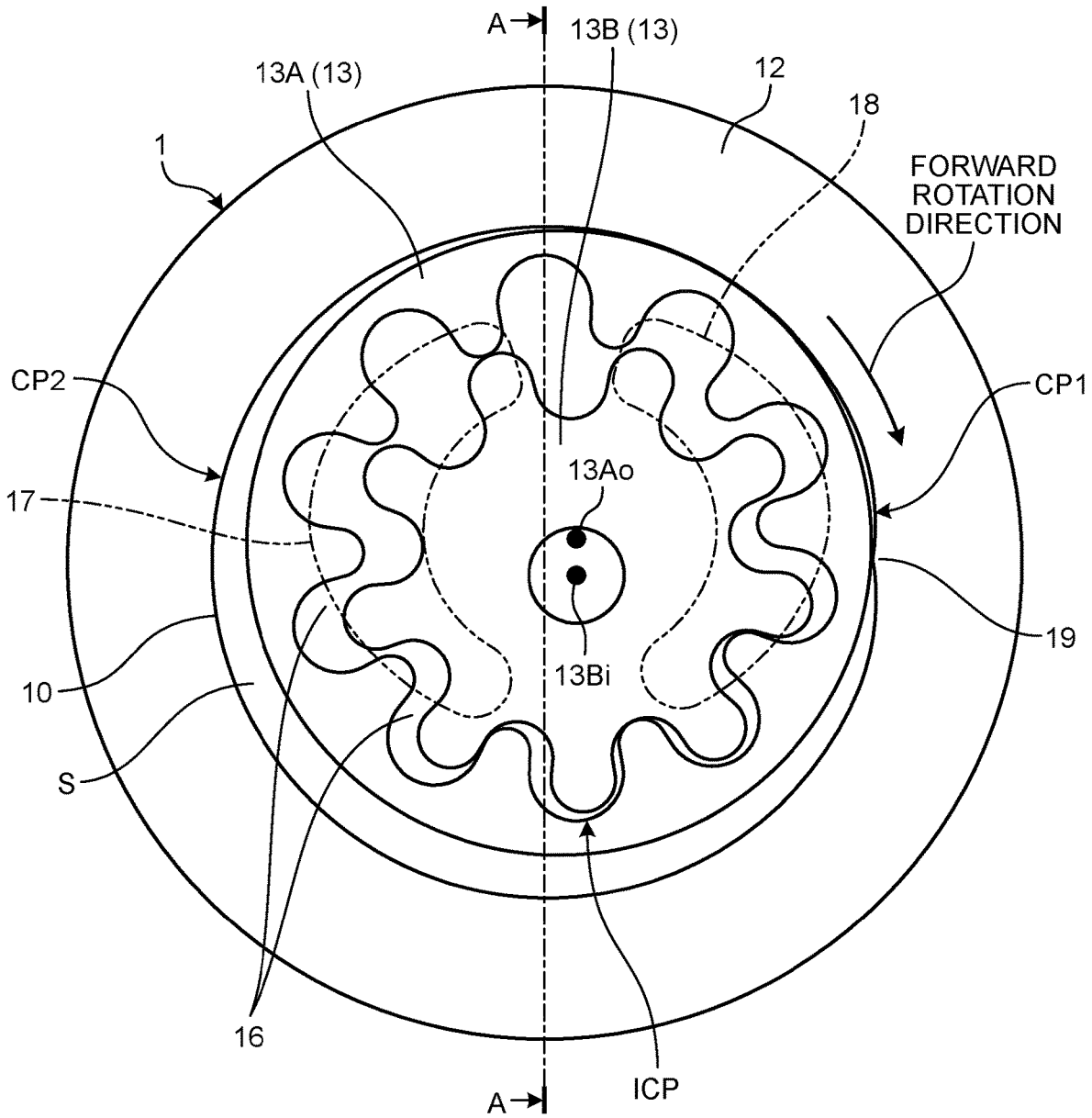
FIG. 2 is a front view schematically illustrating one example of a first oil pump according to the embodiment.
Figure 3:
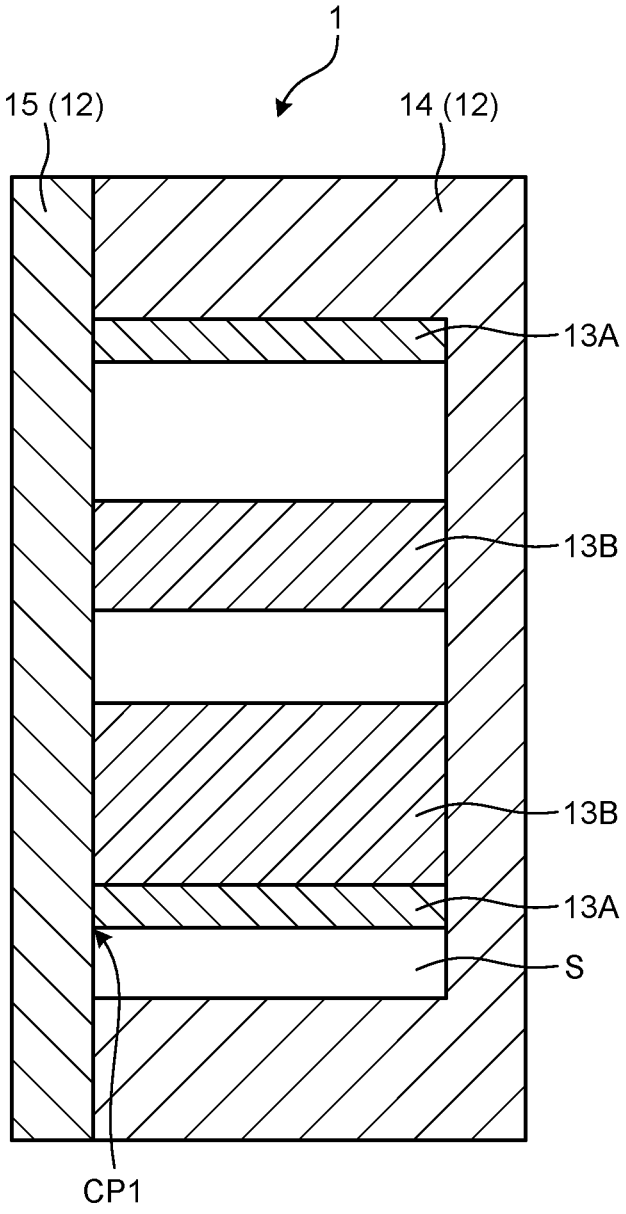
FIG. 3 is a cross-sectional view taken along line A-A in FIG. 2.

FIG. 2 is a front view schematically illustrating one example of the first oil pump 1 according to the embodiment. FIG. 3 is a cross-sectional view taken along line A-A in FIG. 2. Note that FIG. 2 illustrates a rotor 13 of the first oil pump 1 rotating in a forward rotation direction, that is, a clockwise direction in FIG. 2.

The first oil pump 1 in FIGS. 2 and 3 includes a housing 12 and the rotor 13. The housing 12 is fixed to a predetermined fixing portion (not illustrated) such as a transmission case. The rotor 13 is housed inside the housing 12, and rotates while receiving torque from the pump drive motor 3. In the example in FIGS. 2 and 3, the housing 12 includes a pump body 14 and a pump cover 15. The pump body 14 has a bottomed cylindrical shape having a predetermined depth or length in an axial direction. The pump cover 15 closes an opening of the pump body 14 in a liquid-tight state. Two ports are formed in a wall surface in the axial direction of a wall surface of the pump body 14. The ports penetrate the wall surface in a plate thickness direction. As illustrated in FIG. 2, the ports have an arc shape protruding outward in a radial direction. One of the ports communicates with an oil reservoir such as an oil pan, and opens toward an interdental chamber 16 whose displacement gradually increases. That is, one of the ports is the first port 17 that functions as a suction port for supplying oil to the interdental chamber 16 whose displacement gradually increases. The other port of the ports communicates with a place operated by hydraulic pressure, the heat generating portion, and the sliding portion described above. Furthermore, as described later, the other port opens toward the interdental chamber 16 whose displacement gradually decreases. That is, the other port is the second port 18 that functions as a discharge port for discharging oil discharged from the interdental chamber 16 whose displacement gradually decreases to the outside of the housing 12.

The rotor 13 is rotatably disposed inside the housing 12 configured in a liquid-tight state. The rotor 13 includes a ring-shaped outer rotor 13A and an inner rotor 13B. The outer rotor 13A has a plurality of internal teeth, and can move and rotate inside the housing 12. The inner rotor 13B is disposed inside the outer rotor 13A in the radial direction of the outer rotor 13A, and has a plurality of external teeth that meshes with the internal teeth. The tip diameter of the internal teeth of the outer rotor 13A is set to be smaller than the tip diameter of the external teeth of the inner rotor 13B. Furthermore, as illustrated in FIG. 3, the thicknesses and lengths of the outer rotor 13A and the inner rotor 13B in the axial direction are set to be substantially the same as the depth or length of the pump body 14 in the axial direction. This is for preventing oil from flowing between an interdental chamber 16 communicating with the first port 17 and an interdental chamber 16 communicating with the second port 18 by narrowing clearance between the housing 12 and the outer rotor 13A and the inner rotor 13B in the axial direction as much as possible when the outer rotor 13A and the inner rotor 13B rotate in a forward rotation direction and a reverse rotation direction. That is, the outer rotor 13A and the inner rotor 13B are in sliding contact with the pump body 14 and the pump cover 15 to the extent that oil does not leak from the first port 17 and the second port 18.

Furthermore, the inner rotor 13B is coupled to the pump drive motor 3 via the drive shaft 33 (not illustrated). A rotation center axis 13Bi of the inner rotor 13B and a rotation center axis of the pump drive motor 3 are coaxially set. In the example here, the number of external teeth of the inner rotor 13B is set to be smaller by one than the number of internal teeth of the outer rotor 13A. Furthermore, at least a part of the inner rotor 13B is inscribed in the outer rotor 13A. Note that, in the following description, a place where the inner rotor 13B is inscribed in the outer rotor 13A is referred to as an inscribed portion ICP. Furthermore, in the state where at least a part of the inner rotor 13B is inscribed in the outer rotor 13A as described above, a rotation center axis 13Ao of the outer rotor 13A is shifted in the radial direction with respect to the rotation center axis 13Bi of the inner rotor 13B. In the example in FIG. 2, the rotation center axis 13Ao of the outer rotor 13A is located above the rotation center axis 13Bi of the inner rotor 13B in the vertical direction of FIG. 2. Then, the outer rotor 13A rotates about the rotation center axis 13Ao of the outer rotor 13A in an eccentric state. Furthermore, the internal teeth and the external teeth are separated from each other in a portion opposite to the inscribed portion ICP across the rotation center axis 13Bi of the inner rotor 13B in the radial direction. Furthermore, in the inscribed portion ICP, the meshing between the internal teeth and the external teeth progresses with rotations of the outer rotor 13A and the inner rotor 13B, and the displacement of the interdental chamber 16 between the internal teeth and the external teeth gradually decreases. Furthermore, the internal teeth and the external teeth are separated from each other with the rotations of the outer rotor 13A and the inner rotor 13B, and the displacement of the interdental chamber 16 gradually increases on the downstream side of the interdental chamber 16 having the minimum displacement in the rotation direction.

In one example, the pump body 14 has a surface shape obtained by overlapping two circles that are substantially the same as the outer diameter of the outer rotor 13A or slightly larger than the outer diameter of the outer rotor 13A with each other in a state where the centers of these circles are separated from each other and smoothly continuing an edge portion on one side across a line connecting the centers, or a surface shape approximated to such a shape. Therefore, an intersection portion of the two circles of the above-described edge portions protrudes inward in the radial direction on the other side opposite to the one side across the above-described line. The intersection portion comes into contact with the outer peripheral surface of the outer rotor 13A when the outer rotor 13A rotates in the forward rotation direction or the reverse rotation direction. The intersection portion functions as a stopper (hereinafter, referred to as stopper 19) that restricts movements of the outer rotor 13A in the housing 12 accompanying the rotation of the outer rotor 13A.

In contrast, as illustrated in FIG. 2, an edge portion on one side of the housing 12 is a smoothly continuous arc surface 10. The radius of curvature thereof is larger than the radius of curvature of the outer diameter of the outer rotor 13A. Thus, space S is formed between the arc surface 10 and the outer rotor 13A. In a transition state in which the rotation direction of the outer rotor 13A is switched, the outer rotor 13A uses the above-described space S to move inside the housing 12 such that the rotation center axis 13Ao of the outer rotor 13A is located on an opposite side across the rotation center axis 13Bi of the inner rotor 13B in a state of being in contact with the arc surface 10.

Furthermore, in the present embodiment, when the outer rotor 13A stably rotates in the forward rotation direction and the reverse rotation direction, drag generated between the housing 12 and the outer rotor 13A at a place (hereinafter, referred to as second contact portion) CP2 where the outer rotor 13A comes into contact with the housing 12 is set smaller than drag generated between the housing 12 and the outer rotor 13A at a place (hereinafter, referred to as first contact portion) CP1 where the outer rotor 13A comes into contact with the housing 12 in a transition state in which the rotation direction of the outer rotor 13A is switched from the forward rotation direction to the reverse rotation direction or from the reverse rotation direction to the forward rotation direction. Here, stable rotation of the outer rotor 13A means rotation in a state where the rotation direction of the outer rotor 13A and the position of the rotation center axis 13Ao of the outer rotor 13A are not changed or changes of the rotation direction of the outer rotor 13A and the position of the rotation center axis 13Ao of the outer rotor 13A are inhibited. Furthermore, in the present embodiment, the outer rotor 13A moves along the arc surface 10 in the transition state in which the rotation direction of the outer rotor 13A is switched, so that the arc surface 10 and a peripheral portion thereof correspond to the second contact portion CP2, and a portion excluding the arc surface 10 and the peripheral portion thereof corresponds to the first contact portion CP1.

Figure 4:
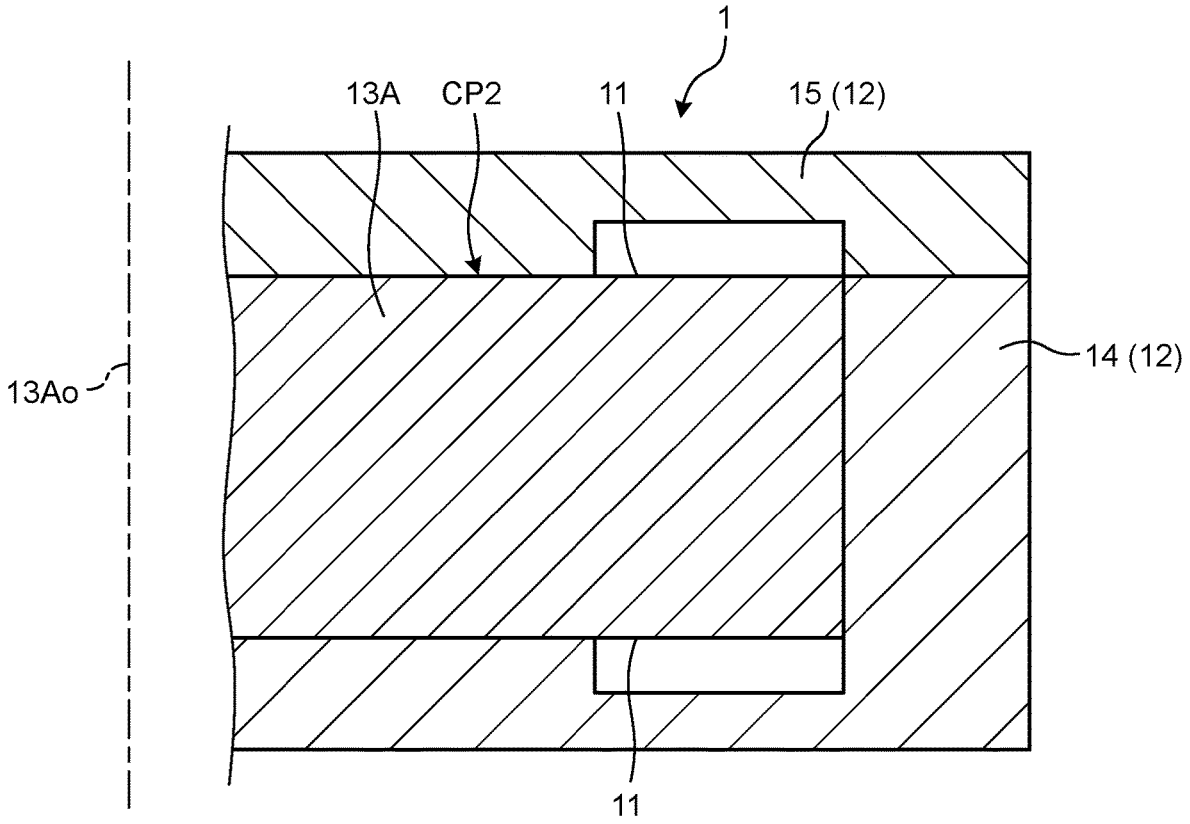
FIG. 4 is a partial cross-sectional view of a housing at a second contact portion.

FIG. 4 is a partial cross-sectional view of the housing 12 at the second contact portion CP2. In the example in FIG. 4, the outer peripheral surface of the outer rotor 13A is in contact with the inner peripheral surface of the housing 12. Furthermore, a recess 11 recessed in the axial direction is formed on a side wall surface, facing an outer peripheral portion of the outer rotor 13A in the axial direction, of the wall surface of the housing 12. In the second contact portion CP2, this configuration makes the contact area between the outer rotor 13A and the housing 12 in the axial direction smaller than that in a case where the recess 11 is not formed. Thus, the drag generated at the second contact portion CP2, that is, frictional force, sliding resistance, and the like between the outer rotor 13A and the housing 12 are reduced by the recess 11. In contrast, in the first contact portion CP1, although not illustrated in detail, the above-described recess 11 is not formed on the side wall surface of the housing 12. Thus, the drag generated at the first contact portion CP1, that is, frictional force, sliding resistance, and the like generated between the outer rotor 13A and the housing 12 in the axial direction are not particularly reduced.

Figure 5B:
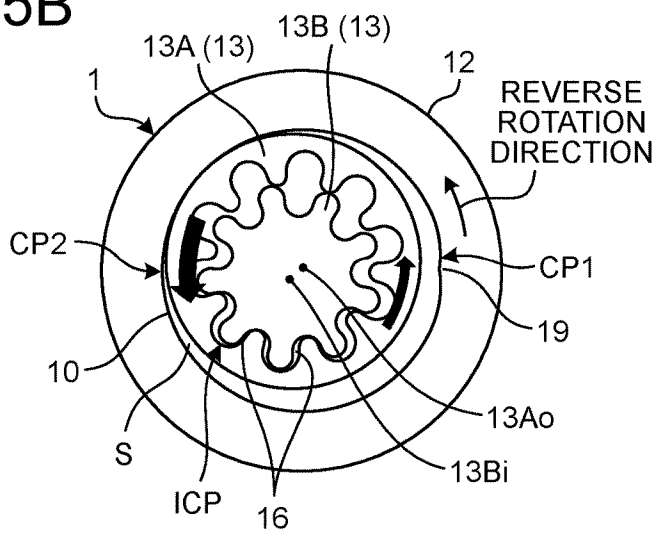
FIG. 5B illustrates the first oil pump in a transition state in which a rotation direction is switched from the forward rotation direction to a reverse rotation direction.
Figure 5A:
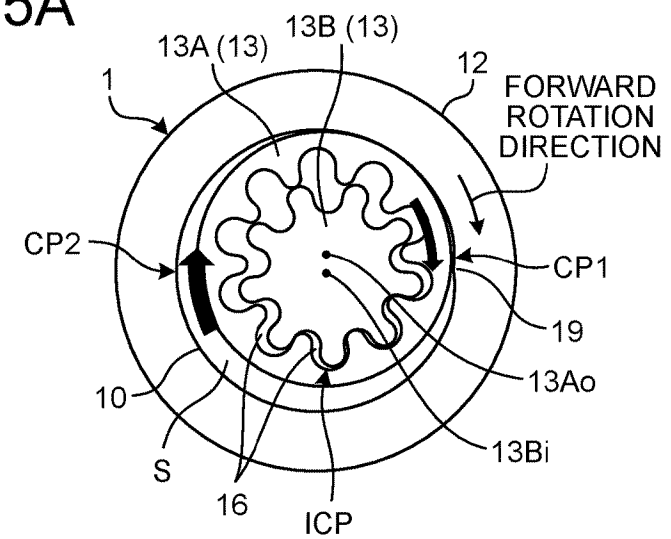
FIG. 5A illustrates the first oil pump rotating in a forward rotation direction.
Figure 5D:
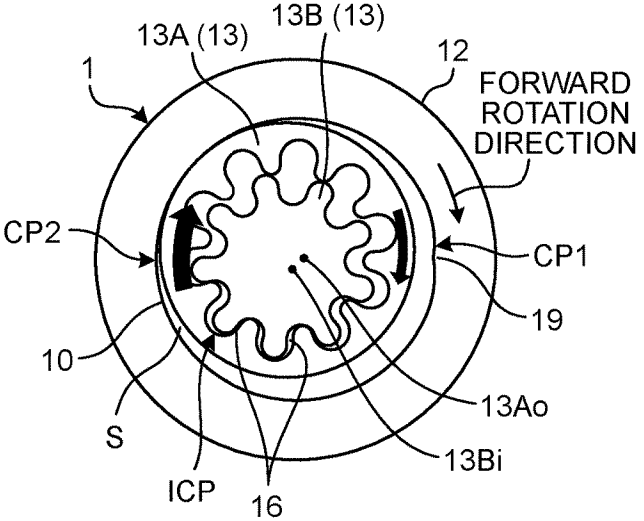
FIG. 5D illustrates the pump in a transition state in which a rotation direction is switched from the reverse rotation direction to the forward rotation direction.
Figure 5C:
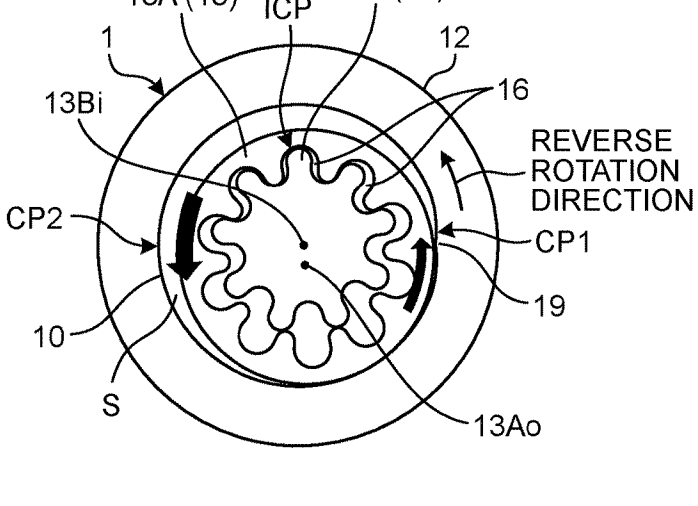
FIG. 5C illustrates the first oil pump rotating in the reverse rotation direction.

Next, action of the first oil pump 1 will be described. FIGS. 5A to 5D illustrate an operation state of the first oil pump 1 according to the embodiment. Specifically, FIG. 5A illustrates the first oil pump 1 rotating in the forward rotation direction. FIG. 5B illustrates the first oil pump 1 in a transition state in which a rotation direction is switched from the forward rotation direction to the reverse rotation direction. FIG. 5C illustrates the first oil pump 1 rotating in the reverse rotation direction. FIG. 5D illustrates the first oil pump 1 in a transition state in which a rotation direction is switched from the reverse rotation direction to the forward rotation direction. Note that, in the example here, the forward rotation means clockwise rotation of the inner rotor 13B in FIGS. 5A to 5D, and the reverse rotation means counterclockwise rotation of the inner rotor 13B in FIGS. 5A to 5D.

When the inner rotor 13B receives torque from the pump drive motor 3 and rotates in the forward rotation direction, the outer rotor 13A receives torque from the inner rotor 13B at the inscribed portion ICP and rotates. Since frictional force and sliding resistance, that is, drag at the second contact portion CP2 are smaller than drag at the first contact portion CP1, force for rotating the outer rotor 13A at the second contact portion CP2 is larger than force for rotating the outer rotor 13A at the first contact portion CP1. In other words, the outer rotor 13A is sandwiched by the housing 12 at the first contact portion CP1, so that the outer rotor 13A rotates clockwise using the first contact portion CP1 as the center or a fulcrum. Note that the above-described forces for rotating the outer rotor 13A having different strengths are described as arrows having different sizes in FIG. 5A.

When the outer rotor 13A rotates clockwise using the first contact portion CP1 as the center or a fulcrum, the outer rotor 13A comes into contact with the inner peripheral surface of the housing 12 on an upper right side in FIG. 5A. Furthermore, the outer rotor 13A continues to rotate forward by receiving torque from the inner rotor 13B, so that the outer rotor 13A moves along the inner peripheral surface of the housing 12 in the rotation direction of the outer rotor 13A, that is, toward a lower right side inside the housing 12 in FIGS. 5A to 5D with the outer rotor 13A being in contact with the inner peripheral surface of the housing 12. Then, finally, the outer peripheral surface of the outer rotor 13A and the stopper 19 come into contact with each other, which prevents movement of the outer rotor 13A. This causes the stopper 19 to receive a load for moving the outer rotor 13A. Thus, the outer rotor 13A and the inner rotor 13B relatively rotate. The displacement of an interdental chamber 16 on an upstream side of the inscribed portion ICP in the rotation directions of the outer rotor 13A and the inner rotor 13B gradually decreases with rotations of the outer rotor 13A and the inner rotor 13B. The displacement of an interdental chamber 16 on a downstream side of the inscribed portion ICP gradually increases with rotations of the outer rotor 13A and the inner rotor 13B. FIG. 5A illustrates this state. Note that this state is maintained until the rotation direction of the outer rotor 13A is switched. Furthermore, in this state, the rotation center axis 13Ao of the outer rotor 13A is located above the rotation center axis 13Bi of the inner rotor 13B in FIG. 5A. The inscribed portion ICP is located below the rotation center axis 13Bi of the inner rotor 13B in the vertical direction of FIG. 5A.

A case where the rotation direction of the outer rotor 13A is switched from the forward rotation direction to the reverse rotation direction will be described. When the inner rotor 13B reversely rotates, the outer rotor 13A rotates counterclockwise using the first contact portion CP1 as the center or a fulcrum while reversely rotating about the rotation center axis inside the housing 12 in FIG. 5B in accordance with a principle similar to the above-described principle. That is, the outer rotor 13A starts to move along the inner peripheral surface of the housing 12 toward a left side in FIG. 5B inside the housing 12. FIG. 5B illustrates the state. Note that the above-described forces for rotating the outer rotor 13A having different strengths are described as arrows having different sizes in FIG. 5B.

Then, the outer rotor 13A reaches the arc surface 10. The outer rotor 13A and the inner rotor 13B continue to rotate reversely and rotate counterclockwise using the first contact portion CP1 as the center or a fulcrum. Thus, the outer rotor 13A moves along the arc surface 10 downward inside the housing 12 while being in contact with the arc surface 10. Then, finally, the outer peripheral surface of the outer rotor 13A and the stopper 19 come into contact with each other. FIG. 5C illustrates the state. Note that this state is maintained until the rotation direction of the outer rotor 13A is switched to the forward rotation direction.

Furthermore, in the state in FIG. 5C, the rotation center axis 13Ao of the outer rotor 13A is located below the rotation center axis 13Bi of the inner rotor 13B. That is, the rotation center axis 13Ao of the outer rotor 13A is located at opposite positions across the rotation center axis 13Bi of the inner rotor 13B between in a case of forward rotation and in a case of reverse rotation. Furthermore, the inscribed portion ICP is located above the rotation center axis 13Bi of the inner rotor 13B. Therefore, the displacement of the interdental chamber 16 gradually decreases on the upstream side of the inscribed portion ICP in the rotation directions of the outer rotor 13A and the inner rotor 13B. The displacement of the interdental chamber 16 gradually increases on the downstream side of the inscribed portion ICP.

Next, a case where the rotation direction of the outer rotor 13A is switched from the reverse rotation direction to the forward rotation direction will be described. When the inner rotor 13B rotates forward, the outer rotor 13A rotates clockwise using the first contact portion CP1 as the center or a fulcrum while rotating forward about the rotation center axis 13Ao in accordance with a principle similar to the above-described principle. That is, the outer rotor 13A starts to move along the arc surface 10 of the housing 12 toward the upper side in FIG. 5D inside the housing 12. Then, the state in FIG. 5A is obtained.

Therefore, in the present embodiment, as described above, when the rotation directions of the outer rotor 13A and the inner rotor 13B are switched, the outer rotor 13A can be rotated while the first contact portion CP1 is used as a fulcrum by reducing drag at the second contact portion CP2 as compared with drag at the first contact portion CP1. Thus, an increase in the number of components and an accompanying increase in manufacturing costs can be prevented or inhibited. Furthermore, when the rotation direction is switched, the rotation center axis 13Ao of the outer rotor 13A is located at opposite positions across the rotation center axis 13Bi of the inner rotor 13B between at the time of forward rotation and at the time of reverse rotation. Thus, regardless of the rotation directions of the outer rotor 13A and the inner rotor 13B, the displacement of the interdental chamber 16 on the upstream side of the inscribed portion ICP described above decreases with rotations of the outer rotor 13A and the inner rotor 13B, and the displacement of the interdental chamber 16 on the downstream side of the inscribed portion ICP increases with rotations of the outer rotor 13A and the inner rotor 13B. Therefore, the suction port and the discharge port are not switched by switching of the rotation direction, so that switching of an oil passage coupled to the suction port and the discharge port in accordance with the rotation direction is unnecessary. That is, an existing oil passage can be used as it is. An increase in manufacturing costs and an increase in pressure loss due to a change in the oil passage can be prevented or inhibited by providing a mechanism for switching the oil passage, such as a check valve.

Figure 6:
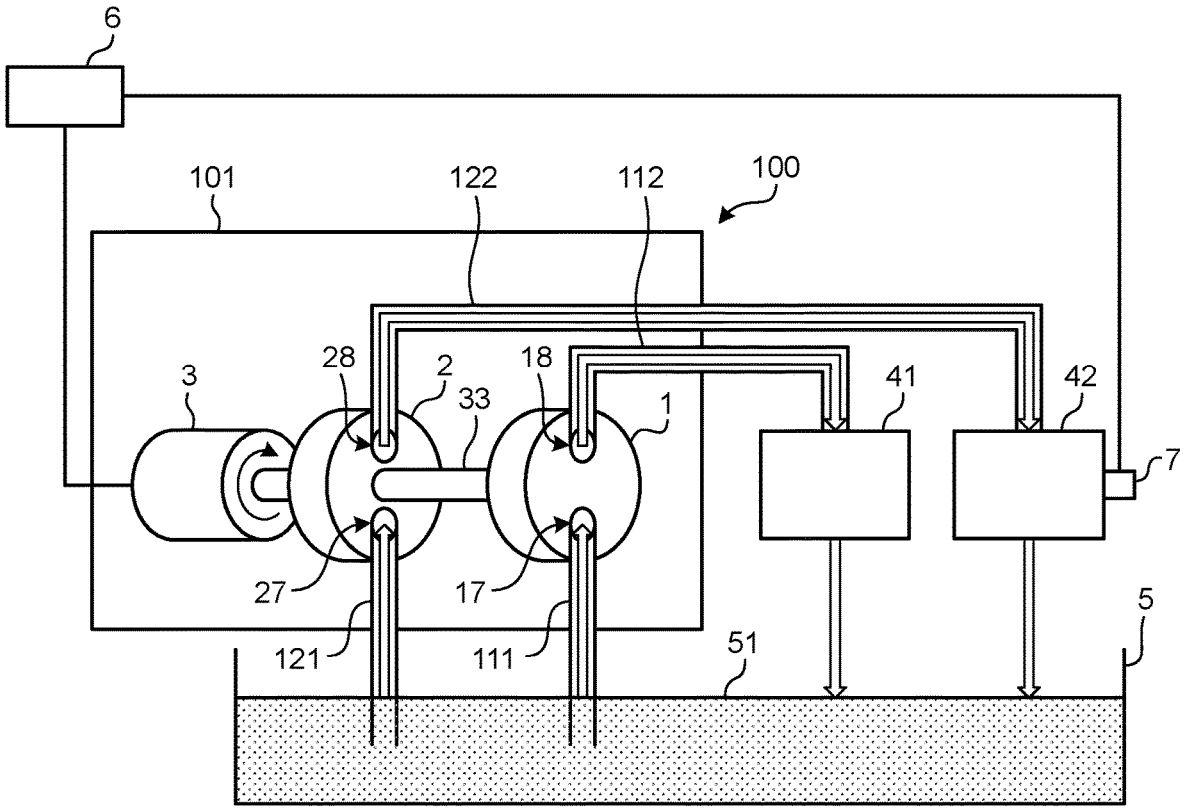
FIG. 6 illustrates an operation state of the pump device at the time of forward rotation.

FIG. 6 illustrates an operation state of the pump device 100 at the time of forward rotation. As illustrated in FIG. 6, the pump device 100 according to the embodiment can supply liquid oil to a gear mechanism 41 and a motor 42. The gear mechanism is a first liquid supply destination, and serves as a sliding portion. The motor 42 is a second liquid supply destination, and serves as a heat generating portion. The pump device 100 includes the first oil pump 1 and the second oil pump 2, which are provided on the same drive shaft 33. In the first oil pump 1, the suction port and the discharge port are not switched between at forward rotation and at reverse rotation. In the second oil pump 2, the suction port and the discharge port are switched between at forward rotation and at reverse rotation. The drive shaft 33 is rotated by the pump drive motor 3, which is a power source whose rotation direction can be optionally switched. Furthermore, an oil pan 5 is provided below the first oil pump 1, the second oil pump 2, the gear mechanism 41, and the motor 42. The oil pan is a reservoir for reserving oil 51.

Then, a lower end of the first oil passage 111 and a lower end of the first oil passage 121 are located in the oil 51 reserved in the oil pan 5. The first oil passage 111 communicates with the first port 17 of the first oil pump 1. The first oil passage 121 communicates with the first port 27 of the second oil pump 2. Note that portions of the first oil passages 111 and 121 outside the case 101 are formed of, for example, tubular oil passage forming members. Furthermore, strainers (not illustrated) are provided at the lower ends of the first oil passages 111 and 121.

The second oil passage 112 communicating with the second port 18 of the first oil pump 1 is connected to the gear mechanism 41 at the end on a side opposite to the side of the second port 18. Furthermore, the second oil passage 122 communicating with the second port 28 of the second oil pump 2 is connected to the motor 42 at the end on a side opposite to the side of the second port 28. Note that portions of the second oil passages 112 and 122 outside the case 101 are formed of, for example, tubular oil passage forming members.

In the pump device 100 according to the embodiment, as illustrated in FIG. 6, when the pump drive motor 3 rotates in the forward rotation direction (clockwise direction in FIG. 6), the first oil pump 1 and the second oil pump 2 are driven in the forward rotation direction as the drive shaft 33 is rotated. As a result, the first oil pump 1 suctions the oil 51 reserved in the oil pan 5 from the first port 17 via the first oil passage 111 and discharges the oil 51 from the second port 18 to the second oil passage 112 to supply the oil 51 from the second oil passage 112 to the gear mechanism 41. Furthermore, the second oil pump 2 suctions the oil 51 reserved in the oil pan 5 from the first port 27 via the first oil passage 121 and discharges the oil 51 from the second port 28 to the second oil passage 122 to supply the oil 51 from the second oil passage 122 to the motor 42. Note that the oil 51 supplied to each of the gear mechanism 41 and the motor 42 is used for lubrication, cooling, and the like at the gear mechanism 41 and the motor 42, and then falls into the oil pan 5 by the weight of the oil 51 itself to be collected.

Figure 7:
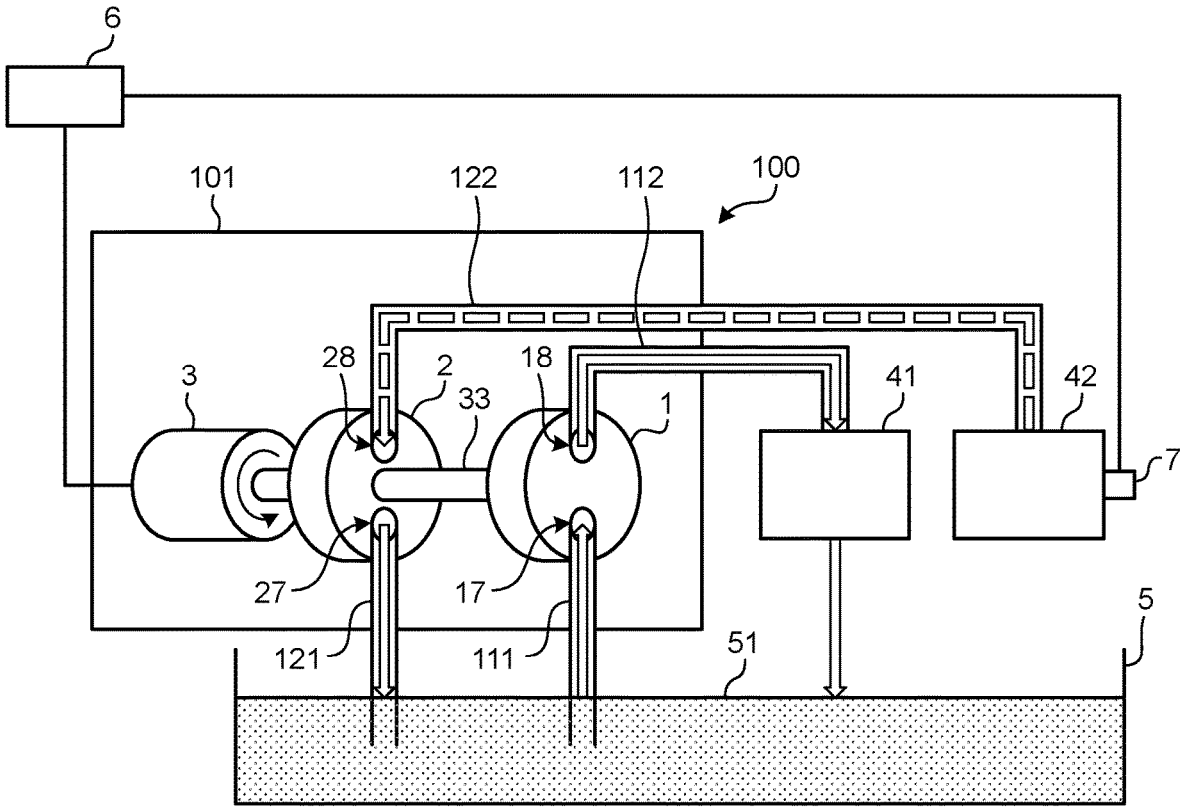
FIG. 7 illustrates an operation state of the pump device at the time of reverse rotation.

FIG. 7 illustrates an operation state of the pump device 100 at the time of reverse rotation. In the pump device 100 according to the embodiment, as illustrated in FIG. 7, when the pump drive motor 3 rotates in the reverse rotation direction (counterclockwise direction in FIG. 7), the first oil pump 1 and the second oil pump 2 are driven in the reverse rotation direction as the drive shaft 33 is rotated. As a result, in the first oil pump 1, functions of the first port 17 and the second port 18 as the suction port and the discharge port are not switched with respect to those at the time of forward rotation. The first oil pump 1 suctions the oil 51 reserved in the oil pan 5 from the first port 17 via the first oil passage 111 and discharges the oil 51 from the second port 18 to the second oil passage 112 to supply the oil 51 from the second oil passage 112 to the gear mechanism 41. Furthermore, in the second oil pump 2, functions of the first port 27 and the second port 28 as the suction port and the discharge port are switched with respect to those at the time of forward rotation. The second oil pump 2 suctions gas (air) on the side of the motor 42 from the second port 28 via the second oil passage 122, and discharges the gas (air) from the first port 27 to the first oil passage 121. Then, the gas discharged to the first oil passage 121 is discharged from the first oil passage 121 toward the oil 51 reserved in the oil pan 5.

In the pump device 100 according to the embodiment, based on a detection result from a temperature detection sensor 7 provided in the motor 42, the pump control device 6 determines that oil supply from the second oil pump 2 to the motor 42 is necessary when the temperature of the motor 42 is equal to or more than a predetermined threshold temperature, and determines that the oil supply from the second oil pump 2 to the motor 42 is unnecessary when the temperature of the motor 42 is less than the predetermined threshold temperature. Then, when determining that the oil supply from the second oil pump 2 to the motor 42 is necessary, the pump control device 6 rotates forward the pump drive motor 3 to supply oil to both the gear mechanism 41 and the motor 42. In contrast, when determining that the oil supply from the second oil pump 2 to the motor 42 is unnecessary, the pump control device 6 reversely rotates the pump drive motor 3 to supply oil only to the gear mechanism 41, and does not supply the oil to the motor 42.

Note that the sensor used for determining whether the oil supply from the second oil pump 2 to the motor 42 is necessary or unnecessary is not limited to the temperature detection sensor 7. Furthermore, it is sufficient if at least one or more sensors are provided.

Figure 8:
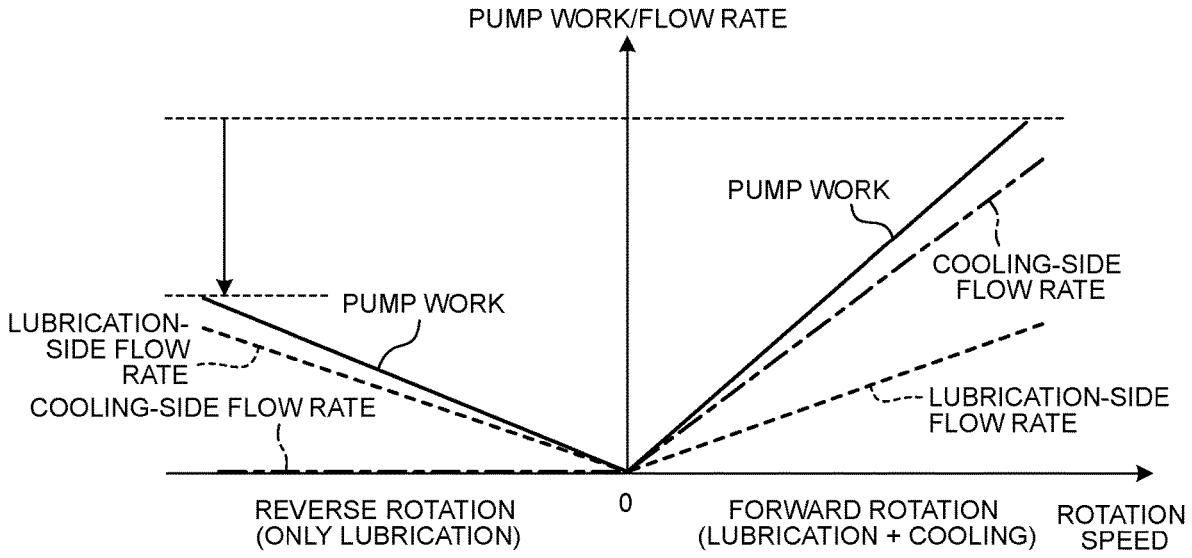
FIG. 8 illustrates pump work and a flow rate at each of the times of forward rotation and reverse rotation.

FIG. 8 illustrates pump work and a flow rate at each of the times of forward rotation and reverse rotation. Note that the horizontal axis in FIG. 8 represents the speed of rotation of the drive shaft 33 caused by the pump drive motor 3. Forward rotation is represented on the positive side. Reverse rotation is represented on the negative side. The pump work in FIG. 8 is the overall work of the pump device 100 in which work in the oil discharge of the first oil pump 1 and work in the oil discharge of the second oil pump 2 are combined. Furthermore, a lubrication-side flow rate in FIG. 8 is a flow rate of oil supplied by the first oil pump 1 to the gear mechanism 41 in accordance with the rotation speed in order to lubricate the gear mechanism 41, which is a lubrication portion. Furthermore, a cooling-side flow rate in FIG. 8 is a flow rate of oil supplied by the second oil pump 2 to the motor 42 in accordance with the rotation speed in order to cool the motor 42, which is the heat generating portion.

In the pump device 100 according to the embodiment, when supply of the oil 51 to the motor 42 is unnecessary, reverse rotation of the pump drive motor 3 makes the cooling-side flow rate zero as illustrated in FIG. 8. The cooling-side flow rate is a flow rate of oil supplied from the second oil pump 2 to the motor 42. Thus, generation of the pump work caused by unnecessary oil supply in the second oil pump 2 can be inhibited. Therefore, as illustrated in FIG. 8, pump work of the pump device 100 at the time of reverse rotation of the pump drive motor 3 can be reduced as compared with pump work of the pump device 100 at the time of forward rotation of the pump drive motor 3. In the former pump work, oil is supplied to the gear mechanism 41 at a flow rate (lubrication-side flow rate) in accordance with the rotation speed, and the motor 42 is not supplied with oil. In the latter pump work, oil is supplied to both the gear mechanism 41 and the motor 42 at a flow rate (lubrication-side flow rate and cooling-side flow rate) in accordance with the rotation speed. Then, torque required for the pump drive motor 3 that drives the first oil pump 1 and the second oil pump 2 is reduced by an amount of reduction of the pump work of the pump device 100 at the time of reverse rotation of the pump drive motor 3. Thus, power supplied to the pump drive motor 3 can be reduced to save energy.

Here, in the pump device 100 according to the embodiment, as illustrated in FIGS. 6 and 7, the first oil passages 111 and 121 are separately connected to the first port 17 of the first oil pump 1 and the first port 27 of the second oil pump 2, respectively. The first oil passages 111 and 121 serve as a suction passage for suctioning the oil 51 reserved in the oil pan 5. Note that an oil structure according to the embodiment can adopt, instead of the first oil passages 111 and 121, a configuration in which one oil passage extending from the side of the oil pan 5 is branched into two oil passages in the middle, one branched oil passage is connected to the first oil pump 1, the other oil passage is connected to the second oil pump 2, and a part of a suction passage for suctioning the oil 51 reserved in the oil pan 5 is shared by the first oil pump 1 and the second oil pump 2. In contrast, in the configuration in which a part of an oil passage is shared by the first oil pump 1 and the second oil pump 2 for suctioning the oil 51 reserved in the oil pan 5, at the time of reverse rotation of the pump drive motor 3, the oil 51 suctioned from the oil pan 5 and gas (air) discharged from the first port 27 of the second oil pump 2 may be mixed to become gas-liquid mixed fluid containing a large amount of gas (air) and suctioned from the first port 17 of the first oil pump 1. Thus, the flow rate of the oil 51 supplied to the gear mechanism 41 may be reduced by the supply of the gas-liquid mixed fluid containing gas (air) from the first oil pump 1 to the gear mechanism 41 as compared with that in a case where only the oil 51 suctioned from the oil pan 5 is supplied from the first oil pump 1 to the gear mechanism 41.

Thus, in the pump device 100 according to the embodiment, as illustrated in FIGS. 6 and 7, the first oil pump 1 and the second oil pump 2 use divided suction passages for suctioning the oil 51 reserved in the oil pan 5. Consequently, it is possible to inhibit gas (air) discharged from the second oil pump 2 from being mixed with oil in an oil passage to be gas-liquid mixed gas and suctioned by the first oil pump 1 at the time of reverse rotation of the pump drive motor 3. As a result, in the pump device 100 according to the embodiment, the flow rate of the oil 51 supplied to the gear mechanism 41 can be increased as compared with that in a case where gas-liquid mixed fluid containing a large amount of gas (air) is supplied from the first oil pump 1 to the gear mechanism 41.

Note that, when the gas-liquid mixed fluid is supplied from the first oil pump 1 that has suctioned the gas-liquid mixed fluid to the gear mechanism 41 due to discharge of gas (air) from the first port 27 of the second oil pump 2 at the time of reverse rotation of the pump drive motor 3, the rotation speed of the first oil pump 1 and thus the rotation speed of the pump drive motor 3 may be increased as compared with that at the time of forward rotation to increase a discharge amount per unit time of the gas-liquid mixed fluid discharged from the first oil pump 1. This can reduce a decrease in the flow rate of the oil 51 supplied to the gear mechanism 41.

The pump device according to the present disclosure exhibits effects that liquid can be supplied to both a first liquid supply destination and a second liquid supply destination at the time of forward rotation, and the liquid can be supplied only to the first liquid supply destination at the time of reverse rotation, so that liquid can be constantly supplied to the first liquid supply destination and liquid can be supplied to the second liquid supply destination only when necessary while an increase in cost is inhibited.

As a result, liquid can be supplied to both the first liquid supply destination and the second liquid supply destination at the time of forward rotation, and the liquid can be supplied only to the first liquid supply destination at the time of reverse rotation. Therefore, liquid can be constantly supplied to the first liquid supply destination and liquid can be supplied to the second liquid supply destination only when necessary while an increase in cost is inhibited.

According to an embodiment, the present disclosure can be applied to a vehicle, and oil can be supplied to a place that needs to be lubricated or cooled with oil. The place includes a sliding portion, such as a reduction gear including a gear mechanism, and a heat generating portion such as a motor. The motor is a rotary electric machine serving as a drive source that is supplied with electric power and that generates driving force for causing the vehicle to travel.

According to an embodiment, when liquid supply to the second liquid supply destination is determined to be unnecessary based on a detection result of a sensor, an occurrence of pump work caused by unnecessary liquid supply in a second pump can be inhibited.

According to an embodiment, it is possible to inhibit gas-liquid mixed gas of gas discharged from a second pump and liquid in a reservoir from being suctioned into a first pump at the time of reverse rotation.

According to an embodiment, even when the gas-liquid mixed fluid is supplied to the first liquid supply destination from the first pump that has suctioned the gas-liquid mixed fluid, a decrease in the flow rate of liquid supplied to the first liquid supply destination can be reduced.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A pump device that supplies a liquid reserved in a reservoir to a gear mechanism and a rotary electric machine, the pump device comprising:

a first pump whose suction port and discharge port are not switched between a forward rotation and a reverse rotation;

a second pump whose suction port and discharge port are switched between at between a forward rotation and a reverse rotation;

a motor that optionally switches a rotation direction of the motor;

a shaft member that is rotated by a driving force from the motor;

a control device that is configured to control at least a rotation direction of the motor; and a temperature detection sensor provided in the rotary electric machine, wherein the first pump and the second pump are provided on the shaft member, the first pump is connected to the gear mechanism, and the second pump is connected to the rotary electric machine, and based on a detection result of the temperature detection sensor, the control device is configured to:

when a temperature of the rotary electric machine is equal to or greater than a threshold value, rotate the motor in a forward direction to supply oil to both the gear mechanism and the rotary electric machine, and when the temperature of the rotary electric machine is less than the threshold value, rotate the motor in a reverse direction to supply oil only to the gear mechanism and not supply oil to the rotary electric machine.

2. The pump device according to claim 1, wherein a suction passage for suctioning the liquid from the reservoir is separately connected to the first pump and the second pump.

3. The pump device according to claim 1, wherein the control device is configured to control a rotation speed of the motor, and increase a rotation speed of the first pump in a case where the motor is rotated in the reverse direction and when gas-liquid mixed fluid is supplied from the first pump to the gear mechanism.

* * * * *